US005890560A

United States Patent [19]

Sloop

[11] Patent Number: 5,890,560

[45] Date of Patent: Apr. 6, 1999

[54] LADDER STABILIZING DEVICE

[76] Inventor: Brian Michael Sloop, 1155 Mistywood La., Harrisburg, N.C. 28075

[21] Appl. No.: 832,392

[22] Filed: Apr. 3, 1997

[51] Int. Cl.[6] ..... E06C 5/36

[52] U.S. Cl. ..... 182/107; 182/93; 182/206

[58] Field of Search ..... 182/93, 107, 116, 182/129, 205, 206, 214; 403/321, 325; 248/210, 211

[56] References Cited

U.S. PATENT DOCUMENTS

| | | | |
|---|---|---|---|
| 2,523,535 | 9/1950 | Little | 182/107 |
| 4,924,971 | 5/1990 | Rice | 182/93 |
| 5,067,588 | 11/1991 | Bendickson | 182/107 |
| 5,282,520 | 2/1994 | Walker | 182/116 |
| 5,655,623 | 8/1997 | Skyba | 182/116 |

*Primary Examiner*—Daniel P. Stodola
*Assistant Examiner*—Hugh B. Thompson
*Attorney, Agent, or Firm*—Adams Law Firm, P.A.

[57] ABSTRACT

A ladder stabilizing device is adapted for attachment to a ladder and to a fixed structure for holding the ladder in a stable condition on a supporting surface adjacent to the structure. The ladder includes a base, a pair of laterally spaced side rails, and a plurality of vertically spaced and laterally extending rungs connected to the side rails. The ladder stabilizing device includes an elongate ladder locking member with a pair of spaced-apart locking grips for being releasibly locked in laterally spaced relation onto one of the rungs of the ladder. An elongate attachment member is rigidly coupled at its first end with the ladder locking member. The opposite second end of the attachment member is adapted for being secured to the fixed structure. A releasable fastener is located at the second end of the attachment member for releasibly attaching the stabilizing device to the fixed structure. The fastener and locking grips cooperate to resist pivoting movement of the ladder about either of the side rails and to maintain the base of the ladder in a fixed and stable position on the supporting surface.

12 Claims, 5 Drawing Sheets

LADDER STABILIZING DEVICE

TECHNICAL FIELD AND BACKGROUND OF THE INVENTION

This invention relates to a ladder stabilizing device used for holding a ladder, such as a conventional extension ladder or straight ladder, in a stable condition on the ground adjacent to a fixed structure, such as a vertical utility pole. The invention acts to resist pivoting movement of the ladder about either of its side rails and sideways shifting of the ladder, and to maintain the base of the ladder in a preset position relative to the fixed structure.

In maintaining and repairing overhead cable lines, workers commonly use a tall extension ladder or straight ladder to access the lines. Because of the instability of the ladder against the utility pole, a second worker is generally required on ground at the base of the ladder to secure the ladder in position as the first worker climbs to the overhead cable lines. The risk of the ladder shifting from its position against the pole and the worker on the ladder falling and being injured greatly increases in the absence of this second worker. The second worker must be attentive and sufficiently strong to stabilize the ladder if necessary in order to avoid an accident and possible injury.

The present invention obviates the need for a second worker at the base of the ladder by providing a ladder stabilizing device which quickly and easily attaches to a rung of the ladder and to the utility pole. The invention effectively stabilizes the ladder during use by preventing twisting, pivoting movement about a side rail, and sideways shifting of the ladder.

SUMMARY OF THE INVENTION

Therefore, it is an object of the invention to provide a ladder stabilizing device which eliminates the need for second worker at the base of the ladder for stabilizing the ladder during use.

It is another object of the invention to provide a ladder stabilizing device which quickly and easily attaches to a rung of the ladder and to the utility pole.

It is another object of the invention to provide a ladder stabilizing device which resists pivoting movement of the ladder about either of its side rails and sideways shifting of the ladder.

It is another object of the invention to provide a ladder stabilizing device which maintains the base of the ladder in a preset position relative to the utility pole.

These and other objects of the present invention are achieved in the preferred embodiments disclosed below by providing a ladder stabilizing device adapted for attachment to a ladder and to a fixed structure for holding the ladder in a stable condition on a supporting surface adjacent to the structure. The ladder includes a base, a pair of laterally spaced side rails, and a plurality of vertically spaced and laterally extending rungs connected to the side rails. The ladder stabilizing device includes an elongate ladder locking member including a pair of spaced-apart locking grips for being releasibly locked in laterally spaced relation onto one of the rungs of the ladder. An elongate attachment member is rigidly coupled at its first end with the ladder locking member. The opposite second end of the attachment member is adapted for being secured to the fixed structure. Releasable fastening means are located at the second end of the attachment member for releasibly attaching the stabilizing device to the fixed structure. The fastening means and locking grips cooperate to resist pivoting movement of the ladder about either of the side rails and to maintain the base of the ladder in a fixed and stable position on the supporting surface.

According to one preferred embodiment of the invention, each of the locking grips includes cooperating over-rung and under-rung hooks adapted for extending respectively over and under the rung of the ladder.

According to another preferred embodiment of the invention, the under-rung hook is pivotably attached to the ladder locking member for pivoting movement between an open position defining a space between the under-rung hook and the over-rung hook for receiving the rung of the ladder and a closed position cooperating with the over-rung hook to lock the grip to the rung.

According to yet another preferred embodiment of the invention, biasing means are provided for normally urging the under-rung hook into the closed position.

According to yet another preferred embodiment of the invention, the ladder locking member includes a hollow end opposite the locking grips for receiving the first end of the attachment member therein.

According to yet another preferred embodiment of the invention, releasable clamping means are located at the hollow end of the ladder locking member for releasibly clamping the attachment member in a locked position relative to the ladder locking member.

According to yet another preferred embodiment of the invention, the releasable fastening means includes a strap extending from the second end of the attachment member for being wrapped around the fixed structure.

Preferably, the strap is made of nylon.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
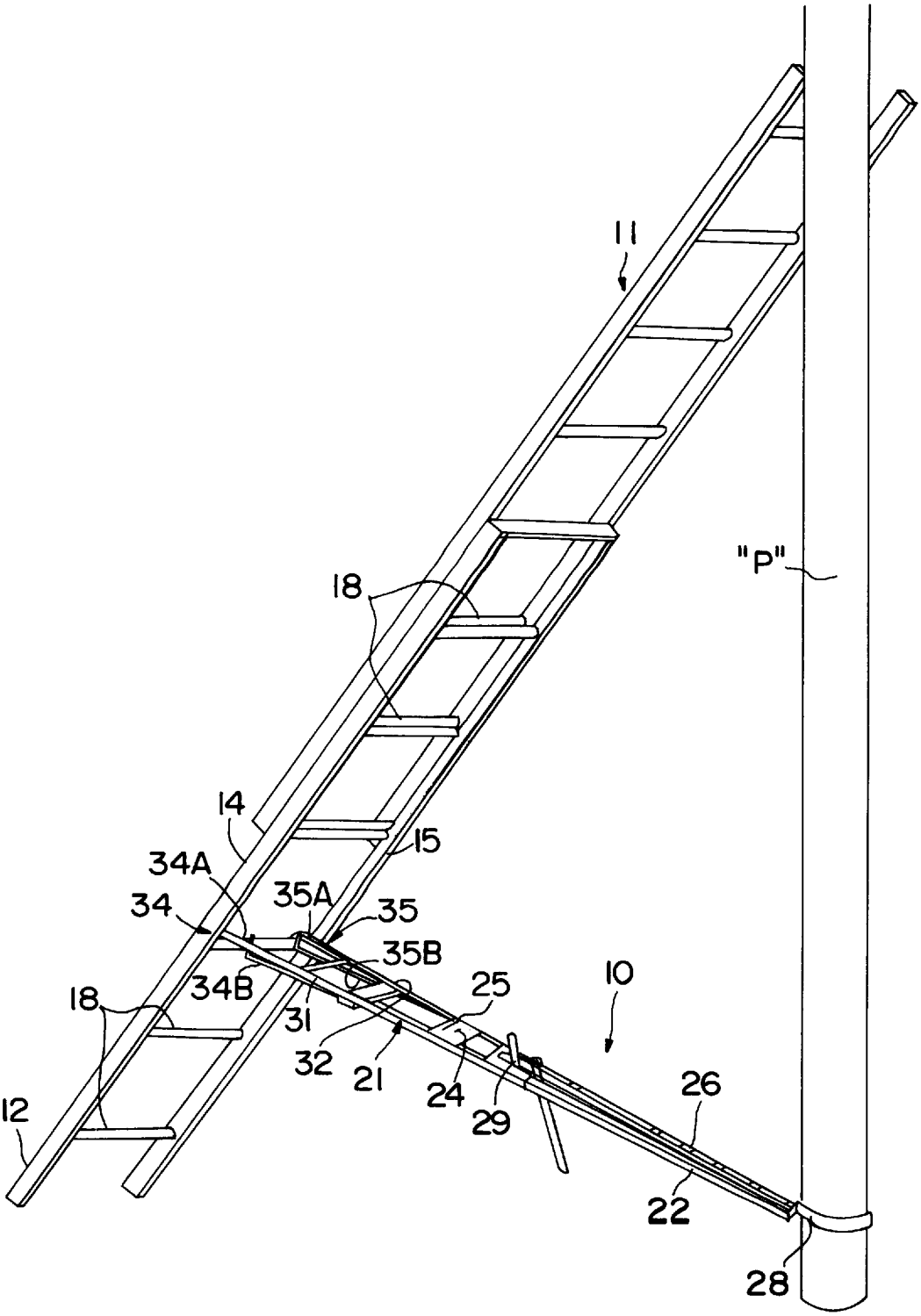
FIG. 1 is an environmental perspective view of the ladder stabilizing device according to one preferred embodiment of the invention.

Referring now specifically to the drawings, a ladder stabilizing device according to the present invention is illustrated in FIG. 1 and shown generally at reference numeral 10. The device 10 is used for holding a ladder 11, such as a conventional extension ladder or straight ladder, in a stable condition on the ground adjacent to a fixed structure "P", such as a vertical utility pole. The ladder 11 includes a base 12, a pair of laterally spaced side rails 14 and 15, and a number of vertically spaced and laterally extending rungs 18 connected to the side rails 14 and 15.

Figures 2A, 2B:
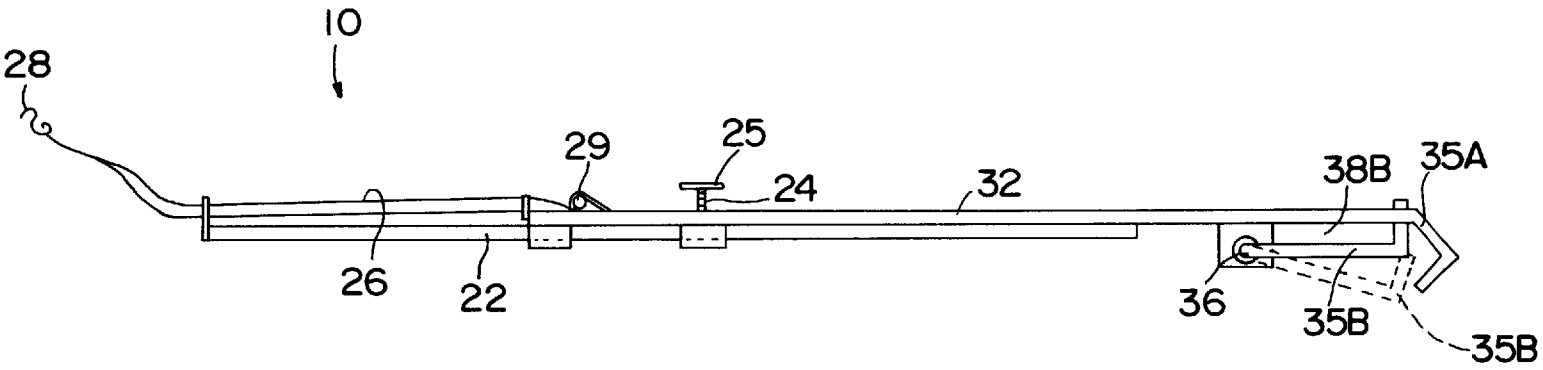
FIG. 2 is a side elevational view of the ladder stabilizing device.
Figure 3:
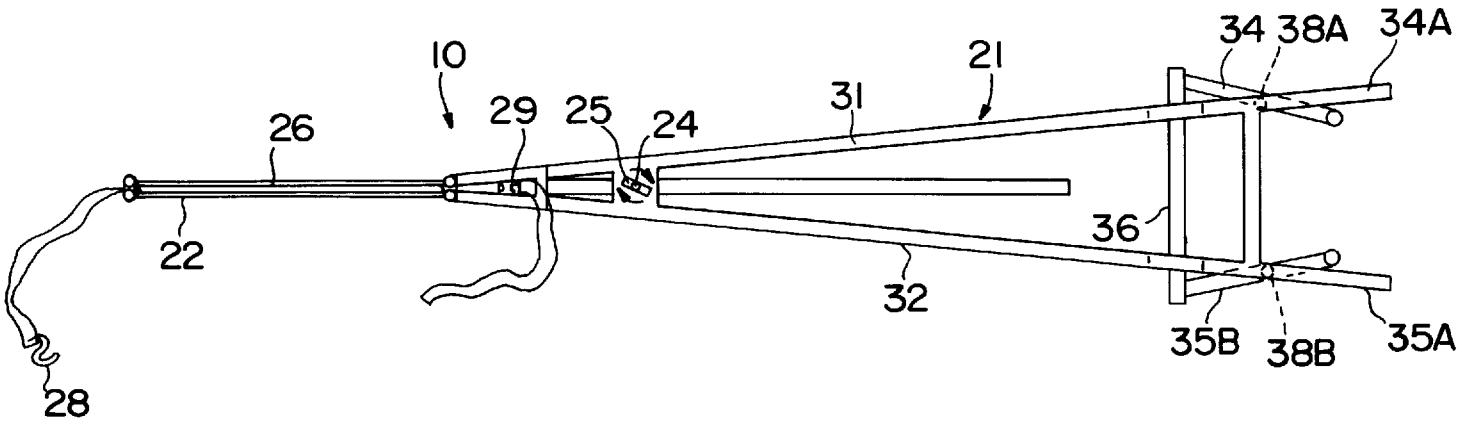
FIG. 3 is a top plan view of the ladder stabilizing device.

Referring to FIGS. 1–3, the stabilizing device 10 is formed of an elongate ladder locking member 21 adapted for being secured at its free end to the ladder 11, and an elongate attachment member 22 rigidly coupled at one end with the ladder locking member 21 and secured at its opposite end to the fixed structure "P". The ladder locking member 21 has a hollow end opposite its free end which slidably receives the attachment member 22 to allow adjustable telescoping movement of the attachment member 22 relative to the ladder locking member 21. The desired length of the attachment member 22 extending outwardly from the ladder locking member 21 is fixed by tightening a threaded set screw 24 extending through the ladder locking member 21 and engaging the attachment member 22. A handle 25 is preferably provided for tightening and releasing the set screw 24.

The free end of the attachment member 22 is releasibly secured to the fixed structure "P", as shown in FIG. 1, by a nylon strap 26 which extends around the structure "P" and attaches to itself using a common "S" hook 28. The opposite end of the strap 26 is attached to the ladder locking member 21 using a conventional ratcheting device 29 for tightening the strap 26 to the structure "P".

The ladder locking member 21 includes a pair of connected arms 31 and 32 diverging from its hollow end, and having respective laterally-spaced locking grips 34 and 35 for being releasibly locked onto one of the rungs 18 of the ladder 11. The lateral spacing between the locking grips 34 and 35 preferably corresponds generally to the distance between the side rails 14 and 15 of the ladder 11. During use of the ladder 11, the locking grips 34 and 35 and strap 26 cooperate to resist pivoting movement of the ladder 11 about either of its side rails 14 and 15 and sideways shifting of the ladder 11, and to maintain the base 12 of the ladder 11 in a fixed and stable position relative to the structure "P".

Figure 4:
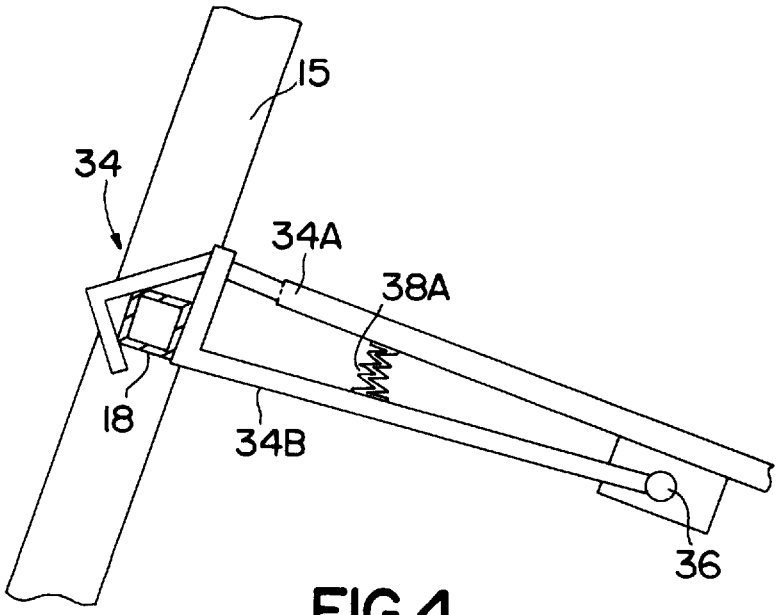
FIG. 4 is a fragmentary view of the ladder stabilizing device showing one of the locking grips in the closed position around the rung of the ladder.
Figure 5:
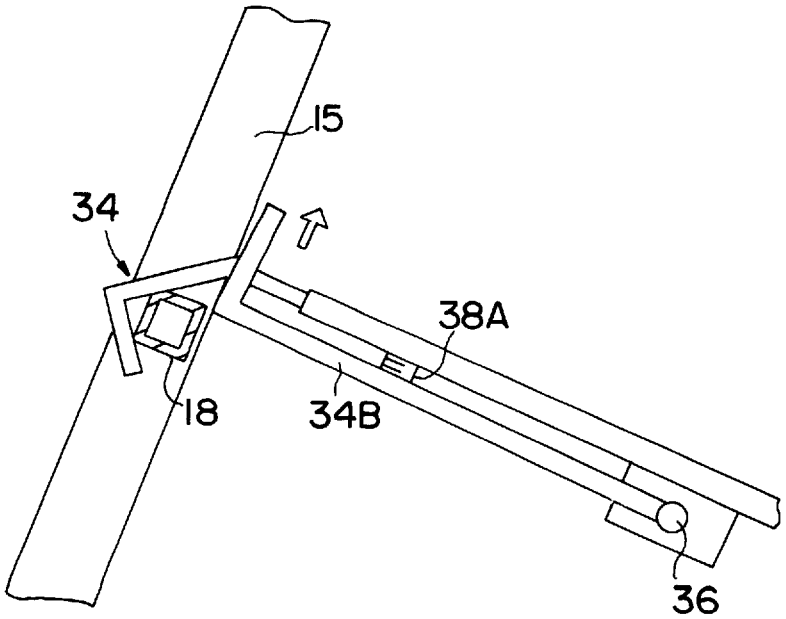
FIG. 5 is a fragmentary view of the ladder stabilizing device showing the locking grip in the open position for receiving the rung of the ladder to attach the device to the ladder, and for removing the device from the rung of the ladder.

As best shown in FIGS. 1, 4 and 5, each locking grip 34 and 35 of the ladder locking member 21 includes cooperating over-rung and under-rung hooks 34A, 34B and 35A, 35B adapted for extending respectively over and under the rung 18 of the ladder 11. The under-rung hooks 34B and 35B are connected to a pivot axis 36 and mounted to the underside of the ladder locking member 21 for unison pivoting movement between a closed position, shown in FIG. 4, and an open position, shown in FIG. 5. In the closed position, the under-rung hooks 34B and 35B reside against the inside of the rung 18 with the over-rung hooks 34A and 35A extending around the outside of the rung 18. The locking grips 34 and 35 cooperate to resist pivoting movement of the ladder 11 about either of the side rails 14 and 15. In the open position, the under-rung hooks 34B and 35B are pivoted upwardly to provide sufficient space between the hooks 34A, 34B and 35A, 35B to receive the rung 18 when attaching the device 10 to the ladder 11, and to remove the device 10 from the ladder 11. A pair of coil springs 38A, 38B (spring 38B shown in FIG. 2) normally urge the under-rung hooks 34B and 35B into the closed position, thereby maintaining the grips 34 and 35 in a locked condition on the ladder 11.

Figure 6:
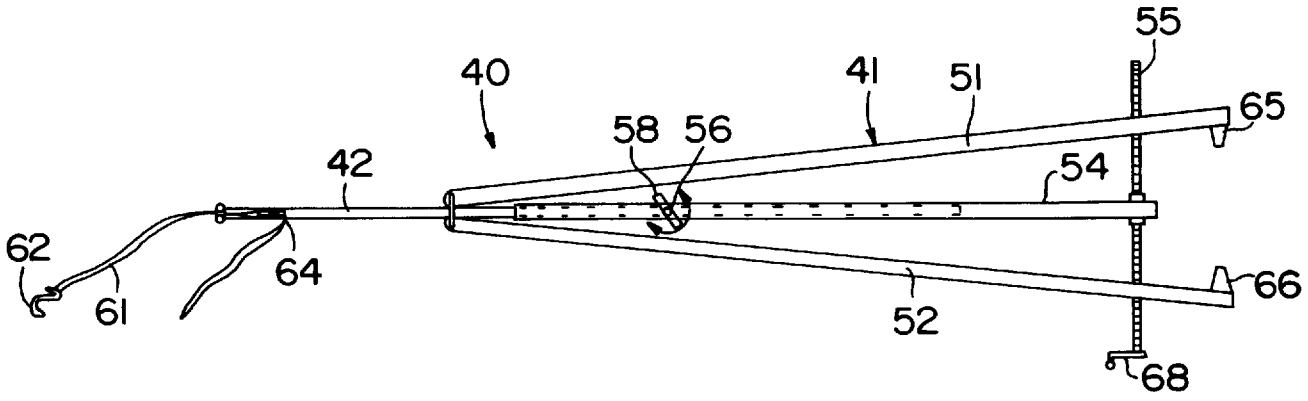
FIG. 6 is a top plan view of the ladder stabilizing device according to another preferred embodiment of the invention.

An alternative embodiment of a ladder stabilizing device 40 according to the invention is shown in FIG. 6. The device 40 is especially adapted for use with a ladder including spaced side rails and rungs, as described above, and openings formed through the outside surface of the side rails at each end of the rungs.

The stabilizing device 40 includes an elongate ladder locking member 41 adapted for being secured at its free end to the ladder, and an elongate attachment member 42 rigidly coupled at one end with the ladder locking member 41 and for being secured at its opposite end to the fixed structure. The ladder locking member 41 includes pivotably connected diverging arms 51 and 52 slightly spaced-apart at the connected end and defining an opening for slidably receiving the attachment member 42 into a hollow center sleeve 54. The sleeve 54 is carried by a threaded spacer bar 55 extending through complementary threaded openings formed in each of the pivoted arms 51 and 52 of the ladder locking member 41.

The sleeve 54 allows adjustable telescoping movement of the attachment member 42 relative to the ladder locking member 41. The desired length of the attachment member 42 extending outwardly from the ladder locking member 41 is fixed by tightening a threaded set screw 56 extending through the sleeve 54 and engaging the attachment member 42. A handle 58 is preferably provided for tightening and releasing the set screw 56. The free end of the attachment member 42 is releasibly secured to the fixed structure by a nylon strap 61 which extends around the structure and attaches to itself using a common "S" hook 62. The opposite end of the strap 61 is attached to the attachment member 42 using a conventional ratcheting device 64 for tightening the strap 61 to the structure.

Laterally-spaced locking projections 65 and 66 are located at free ends of the arms 51 and 52 of the ladder locking member 41 for being inserted into respective openings formed through the side rails of the ladder. The spacing between the locking projections 65 and 66 is adjusted by rotating the spacer bar 55 in a clockwise and counterclockwise direction moving the pivoted arms 51 and 52 in unison to increase and decrease the angle formed between the arms 51, 52. Once this desired spacing is reached, the mating threads of the bar 55 and those in the openings of the arms 51 and 52 cooperate to lock and hold the projections 65 and 66 within the side rail openings of the ladder. During use of the ladder, the projections 65 and 66 and strap 61 cooperate to resist pivoting movement of the ladder about either of its side rails and sideways shifting of the ladder, and to maintain the base of the ladder in a fixed and stable position relative to the structure. Preferably, a handle 68 is provided on an end of the spacer bar 55 for manually rotating the spacer bar 55.

A ladder stabilizing device is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A ladder stabilizing device adapted for attachment to a ladder and to a fixed structure for holding the ladder in a stable condition on a supporting surface adjacent to the structure, the ladder including a base, a pair of laterally spaced side rails, and a plurality of vertically spaced and laterally extending rungs connected to the side rails, said ladder stabilizing device comprising;

(a) an elongate ladder locking member including a pair of spaced-apart locking grips for being releasibly locked in laterally spaced relation onto one of the rungs of the ladder, each of said locking grips comprising cooperating over-rung and under-rung hooks adapted for extending respectively over and under the rung of the ladder, and said under-rung hook being pivotably attached to said over-rung hook for pivoting movement between an open position for receiving the rung of the ladder and a closed position cooperating with the over-rung hook to lock the grip to the rung;

(b) an elongate attachment member rigidly coupled at a first end thereof with said ladder locking member and having an opposite second end thereof adapted for being secured to the fixed structure; and (c) releasable fastening means located at the second end of said attachment member for releasibly attaching the stabilizing device to the fixed structure, said fastening means and locking grips cooperating to resist, pivoting movement of the ladder about either of the side rails and to maintain the base of the ladder in a fixed and stable position on the supporting surface.

2. A ladder stabilizing device according to claim 1, and including biasing means for normally urging the under-rung hook into the closed position.

3. A ladder stabilizing device according to claim 1, wherein said ladder locking member includes a hollow end opposite the locking grips for receiving the first end of the attachment member therein.

4. A ladder stabilizing device according to claim 3, and including releasable clamping means located at the hollow end of the ladder locking member for releasibly clamping the attachment member in a locked position relative to the ladder locking member.

5. A ladder stabilizing device according to claim 1, wherein said releasable fastening means comprises a strap extending from the second end of the attachment member for being wrapped around the fixed structure.

6. A ladder stabilizing device according to claim 5, wherein said strap is made of nylon.

7. In combination with a ladder including a base, a pair of laterally spaced side rails, and a plurality of vertically spaced and laterally extending rungs connected to the side rails, a ladder stabilizing device adapted for attachment to the ladder and to a fixed structure for holding the ladder in a stable condition on a supporting surface adjacent to the structure, said ladder stabilizing device comprising:

(a) an elongate ladder locking member including a pair of spaced-apart locking grips releasibly locked in laterally spaced relation onto one of the rungs of the ladder, each of said locking grips comprising cooperating over-rung and under-rung hooks adapted for extending respectively over and under the rung of the ladder, and said under-rung hook being pivotably attached to said over-rung hook for pivoting movement between an open position for receiving the rung of the ladder and a closed position cooperating with the over-rung hook to lock the grip to the rung;

(b) an elongate attachment member rigidly coupled at a first end thereof with said ladder locking member and having an opposite second end thereof for being secured to the fixed structure; and (c) releasable fastening means located at the second end of said attachment member for releasibly attaching the stabilizing device to the fixed structure, said fastening means and locking grips cooperating to resist pivoting movement of the ladder about either of the side rails and to maintain the base of the ladder in a fixed and stable position on the supporting surface.

8. A combination according to claim 7, and including biasing means for normally urging the under-rung hook into the closed position.

9. A combination according to claim 7, wherein said ladder locking member includes a hollow end opposite the locking grips and receiving the first end of the attachment member therein.

10. A combination according to claim 9, and including releasable clamping means located at the hollow end of the ladder locking member for releasibly clamping the attachment member in a locked position relative to the ladder locking member.

11. A combination according to claim 7, wherein said releasable fastening means comprises a strap extending from the second end of the attachment member for being wrapped around the fixed structure.

12. A combination according to claim 11, wherein said strap is made of nylon.

* * * * *